United States Patent [19]

Katoh et al.

[11] 3,999,249

[45] Dec. 28, 1976

[54] DRIVING METHOD AND APPARATUS FOR A TANDEM CARDING MACHINE

[75] Inventors: Takashi Katoh, Kariya; Yoshinobu Takeyama, Obu, both of Japan

[73] Assignee: Kabushiki Kaisha Toyoda Jidoshokki Seisakusho, Aichi, Japan

[22] Filed: Dec. 19, 1973

[21] Appl. No.: 426,107

[52] U.S. Cl. ..... 19/.2; 19/.23; 19/.25; 19/.26; 19/98

[51] Int. Cl.[2] ..... D01G 31/00; D01G 15/36

[58] Field of Search ..... 19/98, 99, 106 R, 105, 19/.2, .23, .25, .26; 192/125 R, 126–129; 226/11

[56] References Cited

UNITED STATES PATENTS

| | | | |
|---|---|---|---|
| 587,267 | 7/1897 | Meats et al. | 19/.23 |
| 939,750 | 11/1909 | Schmitt | 19/.23 X |
| 1,014,042 | 1/1912 | Brady | 19/.26 |
| 2,400,275 | 5/1946 | Underwood et al. | 19/.24 |
| 3,249,967 | 5/1966 | Varga | 19/98 X |
| 3,251,093 | 5/1966 | Maynard et al. | 19/.26 |
| 3,316,597 | 5/1967 | Nivins | 19/.2 |

FOREIGN PATENTS OR APPLICATIONS

| | | | |
|---|---|---|---|
| 852,417 | 10/1960 | United Kingdom | 19/.2 |
| 1,125,966 | 9/1968 | United Kingdom | 19/.23 |
| 7,002 | 1895 | United Kingdom | 19/106 |

OTHER PUBLICATIONS

Publication "Mill Shatters Carding Limitations," (Textile Industries, Oct. 1961).

*Primary Examiner*—Dorsey Newton

[57] ABSTRACT

A method for driving a Tandem carding machine provided with a fiber tufts supply means, a first and second carding machine, a first web transfer means disposed between the first and second carding machine, a second web transfer means for transferring a continuous web to a coiler motion mechanism, in which the lickerin roller, carding cylinder and a flat mechanism of the second carding machine are driven by a second driving motor while the other rotating elements are separately driven by a first driving motor. To control the sequential motion of the above-mentioned two series of driving mechanisms, said first and second driving motors are electrically connected.

10 Claims, 9 Drawing Figures

DRIVING METHOD AND APPARATUS FOR A TANDEM CARDING MACHINE

SUMMARY OF THE INVENTION

The present invention relates to a driving method and apparatus for a Tandem carding machine.

A Tandem carding machine is made up of two sets of carding machines successively combined one after the other as shown in U.S. Pat. No. 3,249,967. Because a Tandem carding machine has said two sets of carding mechanisms of a relatively large load, the adjustment of sequence between the operations of the two carding mechanisms is very important especially at the time of starting or stopping the entire machine running.

As is well known, the above-mentioned Tandem carding machine comprises a fiber tufts supply mechanism, a first lickerin roller receptive of said fiber tufts from said supply mechanism, a first carding cylinder receptive of fiber tufts from said first lickerin roller for a carding purpose, a first rotary flat disposed above said first carding cylinder, a first doffer receptive of fiber tufts from said first carding cylinder, a first transfer mechanism comprising a plurality of transfer rollers for receiving carded fiber web and for transferring said web to a downstreamly located second lickerin roller of said second carding mechanism, a second carding cylinder receptive of the fiber web from said second lickerin roller for carding purposes, a second rotary flat disposed above said second carding cylinder, a second doffer receptive of said carded fiber web from said second carding cylinder, a second transfer mechanism comprising a plurality of transfer rollers for receiving a continuous fiber web from said second doffer and then transferring said web to downstreamly located calender rollers and a coiler motion mechanism for forming a sliver from said fiber web received from said second transfer mechanism; in other words, the Tandem carding machine generally comprises a fiber tufts supply mechanism, a first carding mechanism, a first doffer, a first web transfer means, a second carding mechanism, a second doffer, a second web transfer means, a pair of calender rollers and a coiler motion mechanism, successively arranged in the above-mentioned order.

It is required at the time of starting the carding operation to start the running of the second carding mechanism before starting the running of said first carding mechanism. When the starting of the entire carding machine is not carried out in this fashion, undesirable stagnation of the fibrous web processed from the first carding mechanism takes place at the web transfer station between the first and second carding mechanisms. Such stagnation of the processed fibrous web tends to cause such serious troubles as an abnormal fibrous web transfer from the first to the second carding mechanism or breakages of carding cloths or metallic wires.

At the time of stopping the running of the entire Tandem machine, it is required that the stopping of the second carding mechanism should precede the stopping of the first carding mechanism; the load on the second carding mechanism being smaller than that on the first carding mechanism. When this operational sequence is not employed, the processed fibrous web will be broken in the area between the two carding mechanisms.

In the conventional driving system of Tandem carding machines, all of the elements are driven by a single common drive motor and the conventional structure of an independent carding machine is adopted in the arrangement of the carding mechanisms of said Tandem carding machine. In the case of Tandem carding machines with such structural features, it is very difficult to keep the operational sequences between the two combined carding mechanisms correctly synchronized due to the relatively large load at the time of starting and the relatively large inertia at the time of stopping the machine.

To overcome the above difficulty the conventional proposal was to drive the separate carding mechanisms by separate drive motors and to drive the other remaining elements by a third separate drive motor. However, this measure has fatal drawbacks in that the entire structure of the Tandem carding machine becomes gigantic and more complicated to control. The entire carding action becomes very troublesome, resulting in increased installation, maintenance and production costs.

Further, in the designing of conventional Tandem carding machines, no special consideration has been given to the association in the driving system of the feed roller and the mechanisms downstream of the web transfer mechanism from the first carding mechanism to the second carding mechanism. Therefore, when the feed roller commences to drive so that the fiber tufts are supplied to the first carding mechanism, and if the successive mechanisms are still not running, it is impossible to prevent the stagnation of fibers or clogging, and consequently serious process troubles will develop.

It is one object of the present invention to provide a driving method and apparatus for a Tandem carding machine of simple and cheap structure, which is free of the above-described drawbacks encountered in the prior art.

It is another object of the present invention to provide a driving method and apparatus for a Tandem carding machine which assures the very smooth and stable driving of the carding mechanisms of said Tandem carding machine having a relatively large starting load and stopping inertia.

It is a further object of the present invention to provide a driving method and apparatus for a Tandem carding machine which assures an excellent operational sequence between the two carding mechanisms forming the main part of the machine.

It is a still further object of the present invention to provide a driving method and apparatus for a Tandem carding machine in which stagnation, clogging of fiber tufts, or breakage of a processed fiber web or sliver is completely eliminated, so that an excellent carding operation can be assured.

To attain the above-mentioned objects, the present invention provides an improved method for driving the Tandem carding machine by a first driving motor and a second driving motor in such a way that the second driving motor drives the second carding mechanism, that is, the second carding cylinder, second rotary flat and the second lickerin roller, while the first driving motor drives the other elements included in the first carding mechanism; that is, the first carding cylinder, the first rotary flat, the first lickerin roller, the feed roller, the first and second doffers, the first and second web transfer mechanisms, the calendar rollers and the coiler motion mechanism.

Therefore, in the apparatus for driving the Tandem carding machine by the first and second driving motors, the particular arrangement of power transmission mechanisms and some auxiliary mechanisms is considered.

BRIEF EXPLANATION OF THE DRAWING

Further features and advantages of the present invention will hereinafter be made clearer with reference to the embodiments shown in the accompanying drawings, in which.

DETAILED ILLUSTRATION OF THE INVENTION

Figure 1:
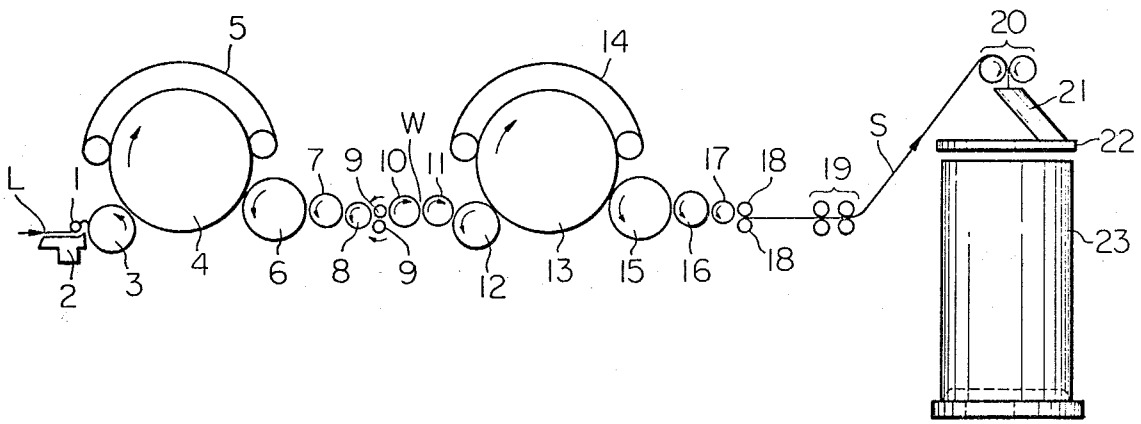
FIG. 1 is a substantially diagrammatic side view of a Tandem carding machine in which the driving method and apparatus according to one aspect of the present invention are embodiments.

The principle of the mechanism for driving the Tandem carding machine is hereinafter described with reference to an embodiment of the present invention shown in FIG. 1. Referring to FIG. 1, a Tandem carding machine is shown comprising a fiber tufts supply mechanism provided with a feed roller rotatably mounted on an dish plate 2, a first carding mechanism, a first doffer 6, a first web transfer mechanism, a second carding mechanism, a second doffer 15, a second web transfer mechanism, a pair of calendar rollers 20, and a coiler motion comprising a coiler tube 21 and a coiler wheel 22. The first carding mechanism includes a first lickerin roller 3, a first cylinder 4 and a first rotary flat 5, while the second carding mechanism includes a second lickerin roller 12, a second cylinder 13 and a second rotary flat 14. The operational sequence of the entire arrangement is so designed that the starting and stopping of the second carding mechanism preceds those of the first carding mechanism and the other driving members. When the Tandem carding machine is to be started for operation, a second motor 67, which is located on the sliver delivery side shown in FIG. 2, is started first, and thereby the rotation of second cylinder 13 is started via a pulley 68, a belt 69 and a pulley 70, while the rotation of the second lickerin roller 12 is also started via a pulley 71, a belt 72 and a pulley 73.

Figure 2:
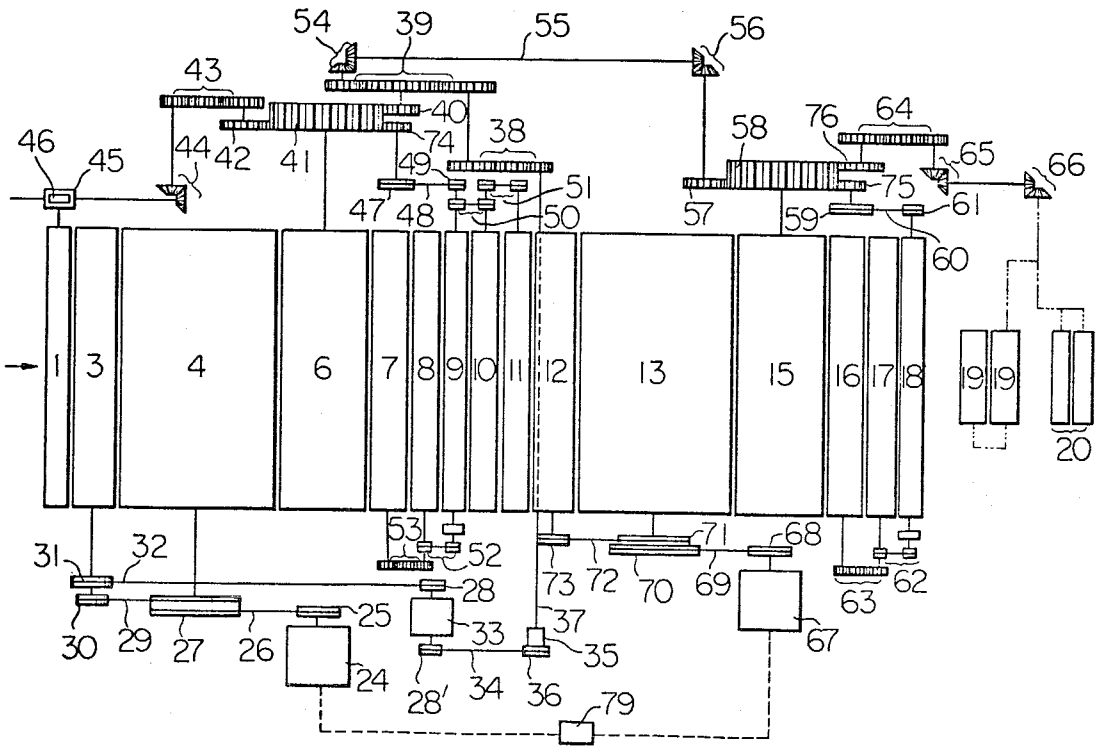
FIG. 2 is a gearing diagram employed in the driving method of the Tandem carding machine shown in FIG. 1.

By starting the first motor 24 on the fiber tufts supply side at a prescribed time following the starting of the second carding mechanism, the rotation of the first cylinder 4 is started at a prescribed rotation speed via a pulley 25, a belt 26 and a pulley 27, while the rotation of the first lickerin roller 3 is also started at a prescribed rotation speed via the pulley 27, a belt 29 and a pulley 30, respectively (see FIG. 2). Concurrently with this procedure, an infinite variable speed device 33 is actuated for operation via a pulley 31 which is coaxial with the first lickerin roller 3, a belt 32 and a pulley 28. This is followed by a corresponding rotation of a transmission shaft 37 together with the actuation of an electromagnetic clutch 35 accompanied by a pulley 36 via a pulley 28′ and a belt 34.

As a result of the above-described procedure, a gear 41 is put into rotation via a first gear train 38, comprised of three sets of gears related to the transmission shaft 37, a second gear train 39 also comprised of three sets of gears and a gear 40. This, on one hand, causes a corresponding rotation of a first doffer 6 and, on the other hand, causes rotation of a worm 45 via a third gear train 43, which is comprised of three sets of gears related to the gear 41 via a gear 42, and a first bevel gear train 44 comprised of two sets of bevel gears. This rotation of the worm 45 induces a corresponding rotation of the feed roller 1 via a worm gear 46 meshing with the worm 45. On the other hand, the first crushing rollers 9, composed of an upper roller and a lower roller which are continuously urged against each other, start their rotation via a gear 74 meshing with the gear 41, a sprocket 47 coaxial with the gear 74, a chain 48 and a sprocket 49. This rotation of the first crushing rollers 9 causes the transfer rollers 10 and 11 to initiate their corresponding rotations via transmission mechanisms 50 and 51 including respective sprockets and chains. Simultaneously with this, rotation of the first transfer roller 8 which is connected to the first crushing rollers 9 via a transmission mechanism 52, and the rotation of the first stripping roller 7 which is connected to the first transfer roller 8 via a gear train 53 are also set into motion. Although not shown in detail in the drawings, the first rotary 5 accompanying the flat cylinder 4 and the second rotary flat 14 accompanying the second cylinder 13 are driven by driving mechanisms related to the pulley 27 mounted coaxially with the first cylinder 4 and the pulley 70 mounted coaxially with the second cylinder 13, respectively.

As is clear from the foregoing description, the first motor 24 is responsible for the driving of the first carding mechanism, the feed roller 1 and the web transferring roller groups comprised of the first doffer 6, the first stripping roller 7, the first transfer roller 8, the first crushing rollers 9 and the transfer rollers 10 and 11. Concurrently with this driving procedure, the driving of the second bevel gear train 54, comprised of two sets of bevel gears related to the above-described second gear train 39 and a gear 57 via a shaft 55 and a third bevel gear drain 56, takes place. Upon rotation of said gear 57, the rotation of the second doffer 15 of the above-described second carding mechanism is started via an accompanying gear 58 meshing with the gear 57. At the same time, the rotation of second pair of crushing rollers 18, is started via a sprocket 59 mounted on the shaft of a gear 75 meshing with the gear 58, a chain 60 and a sprocket 61. This rotation of the second crushing rollers 18 causes a corresponding rotation of a second transfer roller 17 which is connected thereto via a transmission mechanism 62 and also causes rotation of second stripping roller 16 which is connected to the second transfer roller 17 via a gear train 63. Draft rollers 19, which are made up of a pair of upper rollers and a pair of lower rollers, and calender rollers 20, are also started for rotation via the fourth gear train 64 composed of three sets of gears related to a gear 76 meshing with the above-described gear 58, the fourth and fifth bevel gear trains 65 and 66, which are both made up of two sets of bevel gears and a proper transmission mechanism (not shown in the drawing).

Further, the rotation of coiler tube 21 and a coiler wheel 22, shown in FIG. 1, is driven by a proper known coiler motion device which is not shown in detail in the illustration.

In the above mentioned embodiment, stripping rollers 7 and 16 are utilized for stripping webs from the doffers 6 and 15, respectively. However, the conventional fly comb and its driving mechanism can be utilized instead of the above mentioned stripping rollers.

On the Tandem carding machine provided with the driving apparatus of the above-described structure, the material fibers are processed according to the following procedure in accordance with one aspect of the present invention.

As shown roughly in FIG. 1, the bale cotton, or the like, L is supplied to the Tandem carding machine upon the dish plate 2 by a feed roller 1 mounted above the dish plate 2. After being subjected to carding action by the first lickerin roller 3, the first cylinder 4, the first rotary flat 5 and the first doffer 6, respectively, the bale cotton L is taken up in the form of a web W by the first stripping roller 7. By way of the transfer rollers, the web W so taken up, is passed to the second lickerin roller 12, the second cylinder 13, the second rotary flat 14 and the second doffer 15 for further carding action. Web W so carded in two stages, is taken up by the second stripping roller 16, passed to the second transfer roller 17 and the second crushing rollers 18 and is accommodated in the form of a sliver S within a can 23 via the draft rollers 19 and the calendar rollers 20.

The first motor 24 is referred to herein as the first driving mechanism, whereas the mechanism driven by the second motor 67 is referred to herein as the second driving mechanism.

In contrast to the above-described starting procedure of the Tandem carding machine operation, the stopping of same is carried out according to the following procedure.

In the first place, the second motor 67 is switched off in order to stop the operation of the second driving mechanism of the second carding mechanism. Secondly, the first motor 24 is switched off in order to stop the operation of all rotating mechanisms other than the second driving mechanism, i.e. the first driving mechanism and the all rollers connected to the same. In this way, the first driving mechanism, which has a longer deceleration time because of its greater inherent inertia, can be brought to a complete stop in synchronism with the stopping of the second driving mechanism which has a shorter deceleration time as a result of its lesser mechanical resistance.

Further, in the structure of the above-described embodiment of the present invention, gears and sprockets with chains are used for the transmission of rotation between the rollers for web transfer and the rotation of the feed roller and this results in the reliable transmission of rotation between said rollers, resulting further in smooth and instant establishment of the normal machine running condition and the simultaneous stopping of the roller rotations.

As is clear from the foregoing explanation, according to the driving method and apparatus of the present invention, on the Tandem carding machine equipped with multi-staged carding mechanisms, separate carding mechanisms are provided with separate driving mechanisms, in such a manner that one driving motor is responsible for the driving of the cylinder, the lickerin roller and the rotary flat of the second carding mechanism, while the other driving motor is responsible for the driving of the cylinder, the lickerin roller, the rotary flat of the first carding mechanism, and the feed roller and the other accompanying rollers 6–11. In this design, even when the load at the time of starting and the inertia at the time of stopping become large on the first driving mechanism side, those on the second driving mechanism side can be constrained to be as small as possible, and thereby the running of the machine can be very easily controlled. Therefore, when compared with the driving control on the conventional Tandem carding machine, the running of the respective carding mechanisms in the machine arrangement can be very simply and easily controlled with reduced investment on equipment; the sequential adjustments at the time of stopping and starting the operations between the separate carding mechanisms, i.e., between the first and second carding mechanisms, can be accomplished very quickly and exactly and the carding action can thereby be carried out very stably with considerably reduced fiber clogging and web breakage.

However, as a result of repeated mill tests conducted by the inventors of the present invention, it was confirmed that several problems still remained which needed to be solved in order to further develop the meritorious features of the present invention.

The first problem to be solved in this sense resided in the fact that, in the arrangement of the Tandem carding machine shown in FIGS. 1 and 2 the first driving mechanism for elements exclusive of the second cylinder 13, the second lickerin roller 12 and the second rotary flat 14 is driven by the first motor 24, while the second driving mechanism for the second cylinder 13, the second lickerin roller 12 and the second rotary flat 14 is driven by the second motor 67, the load on the first carding mechanism comprised of the first lickerin roller 3, the first cylinder 4 and the first rotary flat 5 is larger than that on the second carding mechanism comprised of the second lickerin roller 12, the second cylinder 13 and the second rotary flat. Due to this difference in load, it is very difficult to place both cylinders simultaneously, at the time of starting the entire machine, under a prescribed normal condition of rotation. Further, should the rotation of the second cylinder 13 be delayed or not be started because of any mulfunction or operational trouble, the starting of the rotation of the first cylinder 4 may cause the accidental clogging of the fiber web at the junction of the second carding mechanism and the first carding mechanism, and such accidental web clogging usually leads to such serious accidents as breakages of either carding cloths or metallic wires.

In addition, when the stoppage of the rotation of the second cylinder 13 is delayed considerably relative to that of the first cylinder 4, the fiber web is broken, which impedes the smooth restarting of the carding operation and causes the formation of an uneven web junction leading to the development of corresponding sliver unevenness.

According to one aspect of the present invention, the above-described problem related to the difference in load can be solved in the following manner. The motors 24 and 67 of the first and second driving mechanisms are so correlated in their operational sequence that, at the time of the starting of the entire machine arrangement, the first motor 24 does not start as long as the second motor 67 remains stationary whereas, at the time the entire machine is stopped, the stopping of the second motor 67 for the second carding mechanism of a smaller load precedes that of the first motor 24. By correlating the operational sequence in this manner, the driving of the cylinders having relatively large loads and inertia can be smoothly controlled, and occurrence of the web breakages and development of uneven sliver junctions can accordingly be effectively prevented.

Figure 3:
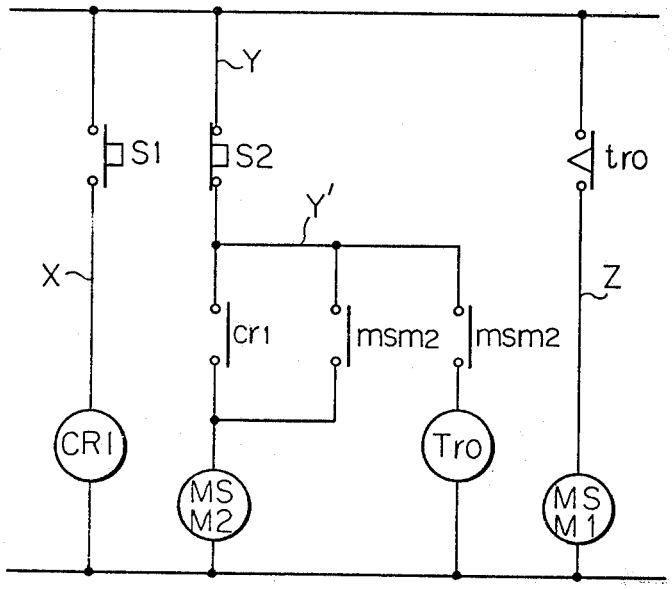
FIG. 3 is an electric circuit diagram for controlling the first and second driving systems of the Tandem carding machine shown in FIG. 1.

In one form of electrical system accomplishing this purpose, the first and second motors 24 and 67 are connected to a motor operating part 79 as shown in FIG. 3. In the electric arrangement shown in FIG. 3, the first motor 24 never starts its rotation before the starting of the second motor rotation, whereas the stopping of the rotation of the second motor precedes the stopping of the rotation of the first motor.

When it is time to start the running of the entire Tandem carding machine arrangement shown in FIGS. 1 and 2, a start switch $S_1$ in the arrangement shown in FIG. 3 is depressed to close a circuit X. The resulting excitement of a relay $CR_1$ closes its contact $C_{rl}$ in a circuit Y provided that a stopper switch $S_2$ in said circuit Y is closed in advance. At this point a starter relay $MSM_2$ for the second motor 67 is excited and the rotation of the second motor 67 is thereby started, contacts $msm_2$ in a branch circuit Y′ are closed, an instantaneous timer $Tr_o$ is excited after a predetermined time so as to close its contact $tr_o$ in a circuit Z, and a starter relay $MSM_1$ for the first motor 24 is excited so as to start the rotation of the first motor 24.

Because the two motors, 24 and 67, are started for rotation in the above-described sequence, the starting of the second driving mechanism takes place first, so that both the second cylinder 13 and the second lickerin roller 12 start to run at the prescribed rotation speeds. Following this, the first driving mechanism is started up for operation so that the first cylinder 4, the first lickerin roller 3 and other rollers 6–11 belonging to the group start running at the prescribed rotation speeds, respectively. In accordance with this procedure, the bale cotton L, or the like, supplied by the feed roller 1 is subjected to the carding action by the first carding mechanism, passed quickly in the form of a web to the second carding mechanism via the transfer roller groups, subjected to further carding action by the second carding mechanism and quickly received in the form of a sliver S within the can 23 via the web let-off arrangement.

When it is time to stop the running of the entire Tandem carding machine arrangement, the stop switch $S_2$ is depressed, the relay $MSM_2$ for the second motor 67 is deenergized to open the contacts $msm_2$ and rotation of the second motor 67 is stopped. The timer $Tr_o$ is also deenergized several seconds later so as to open the contact $tr_o$ and relay $MSM_1$ is deenergized so as to stop rotation of the first motor 24.

Therefore, after the second driving mechanism has stopped so as to completely stop the rotation of the second cylinder 13 and the second lickerin roller 12, the first driving mechanism also stops so as to stop the rotations of the first cylinder 4, the first lickerin roller 3 and other accompanying rollers 6–11.

As will be well understood from the foregoing explanation, according to one aspect of the present invention, the separate carding mechanisms are equipped with separate driving mechanisms and the driving motors of said respective driving mechanisms are electrically connected to a common motor operating circuit. The operational sequence of the two driving motors is designed so that the rotation of the first driving motor, which is responsible for driving the first carding mechanism comprised of the cylinder, the lickerin roller, the doffer, the feed roller, the web transfer rollers and the web let-off roller, will never be started before starting the rotation of the second driving motor, which is responsible for the cylinder 13 and the licker-in roller 12 of the second carding mechanism, while the first driving motor will be stopped at a predetermined time interval after the complete stop of the running of the second motor. In this way, both cylinders, having relatively large loads when starting and considerable inertia when stopping, can be driven very smoothly and the operational sequence between the two can be excellently controlled. Further, accidental web clogging and other operational troubles caused by non-operation of the second motor can be effectively prevented, as can possible web breakages resulting from early stopping of the first motor.

Another problem to be solved in the practice of the present invention was the abnormal winding of the bale cotton around the feed roller and/or of the web around the clearer rollers accompanying the stripping rollers.

When the bale cotton is caught by being wound around the feed roller 1, supplying the bale cotton to the first lickerin roller 3, the absence of the bale cotton supply leads to a considerably lowered running efficiency of the machine and also to breakages in the bale cotton supply mechanism including the feed roller 1. On the other hand, when the web is caught by being wound around the clearer rollers, accompanying the stripping rollers for stripping the web from the doffers, the absence of transfer of the web to the following processes may cause various operational troubles in those processes and the undesirable waste of the web. Further, as the second lickerin roller 12 and the second cylinder 13 are driven by a drive source independent of that of the remaining mechanisms, mechanical difficulties in this drive transmission system may induce undesirable web clogging on the web supply side to the second lickerin roller 12. This is due to the fact that, even when both the second lickerin roller 12 and the second cylinder 13 cease their rotation, the remaining mechanisms continue to run. Such web clogging is apt to cause a greater malfunction in the entire mechanical system.

Further, when the web is caught by being wound around the calender rollers 20, it may cause breakage of calender rollers 20 together with a considerable reduction of sliver productivity. The breakage of the sliver at any position upstream of the calander rollers 20 also brings about a similar reduction of sliver productivity. In addition to the foregoing difficulties, the clogging of the sliver in the coiler tube 21 of the terminal carding process may cause the sliver to fall out of the coiler tube and the sliver in so doing may wind around the accompanying roller arrangements, resulting in serious malfunctions in the carding system. All of the above-described difficulties tend to cause serious malfunctions in the entire carding system and a considerable reduction of the production efficiency of the carding machine. In order to prevent the above-mentioned difficulties, the Tandem carding machine is usually equipped with local devices for detecting the causes of the above-mentioned difficulties. However, conventional methods for this are not practical, because when the detecting device detects the cause of the trouble, the driving motor is instantly stopped by a control motion device actuated by a signal or motion of the detecting device. Consequently, when the carding machine is restarted, by starting the driving motor, a relatively long time is required to attain normal running speed of the carding machine, because of its relatively large moment of inertia. The above-mentioned delay in the normal running of the carding machine impedes its production efficiency. Further, the abnormal driving at the carding machine during the above-mentioned acceleration period causes development of undesirable unevenness of the sliver.

According to one aspect of the present invention, the above-described problems can be solved in the following manner. Upon detection of the web and/or sliver clogging and/or malfunction in the drive transmission mechanism, only the rotations of the feed roller and other rollers, are stopped, while the rotations of the card cylinders 4, 13 which have relatively large inertia are continued. In combination with this, an automatic device for cutting off the supply of the fiber tufts is provided. By these measures, web and/or sliver clogging and/or drive transmission mechanism malfunction can be prevented; the sliver can always be produced very stably and safely and the running of the fiber tuft supply mechanism and related mechanisms can be stopped and restarted very smoothly at any required time.

Further features and advantages of the above-described devices will hereinafter be explained in more detail with reference to FIGS. 4 through 9.

Figure 4:
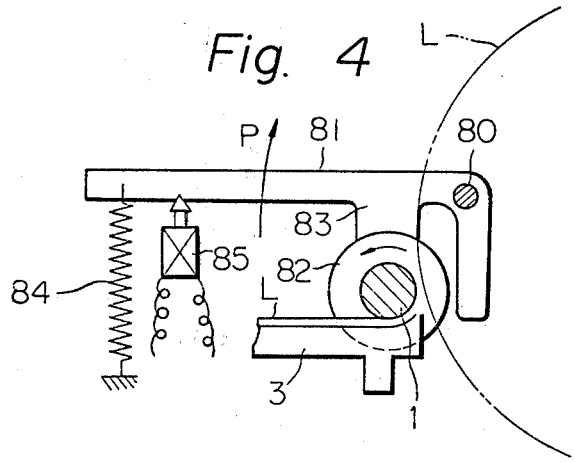
FIG. 4 is a simplified elevational side plan view of the detector mechanism accompanying the feed roller of the Tandem carding machine, shown in FIG. 1.

In the arrangement shown in FIG. 4, an F-shaped detector lever 81 is pivotally mounted at its apex on a supporter shaft 80 disposed to the machine frame (not shown) near the feed roller 1. Said detector lever 81 is provided with a detector nose 83, which extends from the horizontal arm of the lever 81, towards the feed roller 1, and its lower end abuts against the periphery of a boss 82 of the feed roller 1. A tension spring 84 is disposed between the end of the horizontal arm of the lever 81 and the machine frame. Thereby the lever 81 is so urged that the lower end of the nose 83 is always in resilient pressure contact with the feed roller boss periphery. A limit switch 85 which governs the condition of the electro-magnetic clutch 35 shown in FIG. 2, is located under the horizontal arm of the lever 81 in such an arrangement that the switch 85 is switched on and off by the turning of the lever 81. The purpose and function of this arrangement is detection of abnormal winding of the bale cotton L around the feed roller 1.

Figure 5:
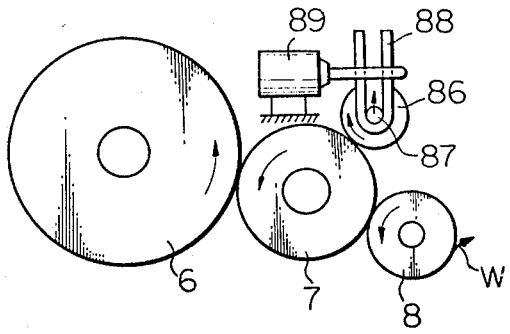
FIG. 5 is a schematic elevational side plan view of a detector mechanism for detecting fibers caught on the clearer roller accompanying the doffer roller, shown in FIG. 1.

An embodiment for detecting the abnormal winding of the web W around the clearer roller 86 accompanying the stripper roller 7 according to the aspect of the present invention is shown in FIG. 5, in which the clearer roller 86 is arranged in a superficial sliding engagement with the stripping roller 7. A supporting member 88 is provided so as to support the clearer roller 86 via a supporter shaft 87 in a vertically adjustable fashion. In combination with this supporting member, a limit switch 89 is provided for governing the condition of the above-described electro-magnetic clutch 35 in such an arrangement that the switch 89 is switched on or off by the vertical movement of the clearer roller 86. Abnormal winding of the web W around the clearer roller 86 causes a corresponding lifting of the clearer roller 86, and, when this lifting exceeds a prescribed limit, the limit switch 89 is switched on via the supporting member 88.

Figure 6:
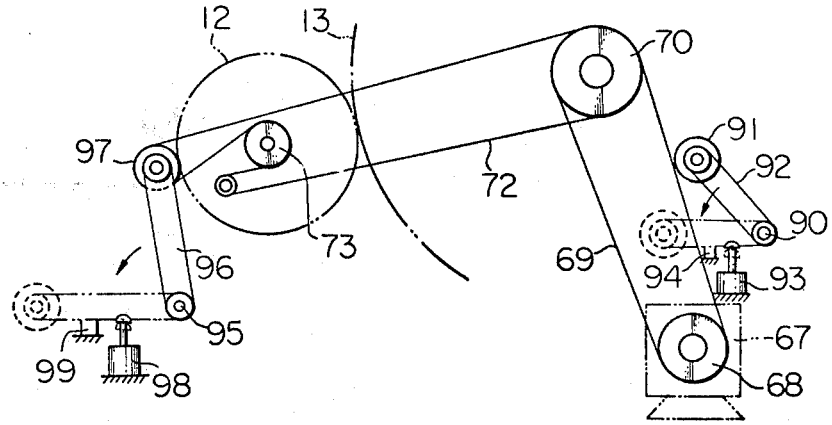
FIG. 6 is a schematic elevational side plan view of a detector device for detecting breakages of the driving belt used on the driving apparatus for the Tandem carding machine according to one aspect of the present invention.

An embodiment for detecting malfunctions in the drive transmission mechanisms according to one aspect of the present invention is shown in FIG. 6. In the drive transmission mechanism from the second drive motor 67 to the second cylinder 13 and the second lickerin roller 12, the belt 69 extends between the pulley 68 of the second drive motor 67 and the pulley 70 of the second cylinder 13. In surface running contact with this belt, 69, a detector roller 91 is carried at the free end of a tiltable lever 92 which is mounted on the machine framework at pivot 90. In combination with said lever 92, a limit switch 93 is provided for governing the condition of the above-described electro-magnetic clutch 35 in such an arrangement that the switch 93 is switched on or off by tilting the lever 92 over a predetermined extent. A stopper 94 is provided near the limit switch 93 in order to constrain excessive tilting of the lever 92.

The belt 72 is extended between the pulley 70 of the second cylinder and the pulley 73 of the second lickerin roller 12. A tiltable lever 96 mounted on the machine framework at a pivot 95 carries a tension roller 97 on which the belt 72 runs. Said lever 96 is accompanied by a limit switch 98 for governing the condition of the above-described electro-magnetic clutch 35 in such an arrangement that the tilting of the lever 96 over a prescribed extent activates the limit switch 98. A stopper 99 is provided in order to restrain the possible excessive tilting of the lever 96. The above-described detecting device is responsible for the detection of breakage of the drive belts 69 and 72. Further, although not shown in the drawings, the two tiltable levers, 92 and 96, are practically accompanied with suitable spring mechanisms such as coil springs, for continuously resiliently urging the levers 92 and 96 towards their associated limit switches 93 and 98, i.e. the counterclockwise direction in the drawing.

Figure 7:
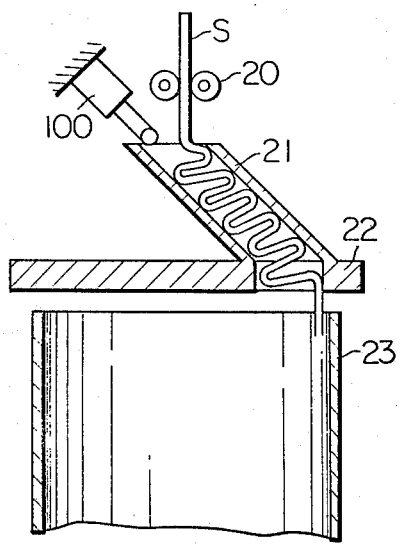
FIG. 7 is a schematic cross sectional side plan view of a part of a detector device for detecting sliver clogging in the coiler arrangement supplementarily disposed to the driving apparatus for the Tandem carding machine according to one aspect of the present invention.

A practical embodiment for detecting abnormal sliver clogging in the coiler tube 21 in accordance with one aspect of the present invention is shown in FIG. 7. In this arrangement, a limit switch 100 for governing the condition of the above-described electro-magnetic clutch 35 is located relative to the upstream terminal of the coiler tube 21 in such an arrangement that the same senses overflowing of the sliver S out of the coiler tube 21 as a result of the sliver clogging.

Figure 8:
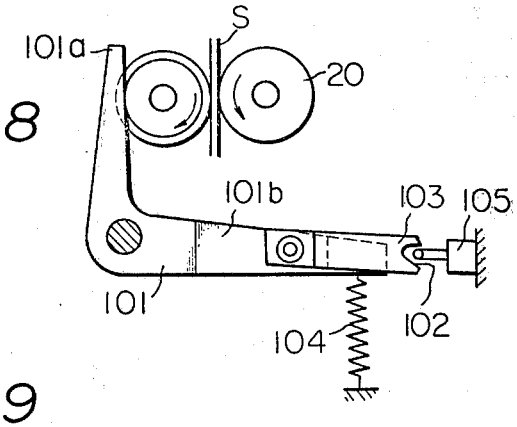
FIGS. 8 and 9 are schematic side plan views of detector mechanisms for detecting mulfunctions of the calendar part supplementarily disposed to the driving apparatus as in the case of the arrangement shown in FIG. 7, respectively.
Figure 9:
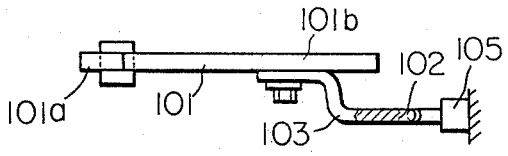

Referring to FIGS. 8 and 9, a device is shown for detecting the abnormal winding of the sliver S around the calender roller and the accidental breakage of the sliver in the area near the calender rollers in accordance with one aspect of the present invention. In the illustrated structure, an L-shaped detector lever 101 is turnably mounted on the machine framework at its apex and, at one end, carries a detector piece 101a in abutment against one of the calender rollers 20. The horizontal arm of the lever 101 forms a pressor piece **101*b* to a stem of which a Z-shaped operator lever 103 is externally fixed. Said operator lever 103 is provided with a U-shaped cut-out 102 formed at one end thereof. The detector lever 101 is so urged by an associated tension spring 104 that its detector piece, 101***a*, is put into resilient pressure contact with the one of the calender rollers 20. A limit switch 105 is arranged facing the end of the operator lever 103 with its operating piece received within the center part of the U-shaped cut-out 102 of the operator lever 103. Said limit switch 105 governs the condition of the above-described electro-magnetic clutch 35. The winding of the sliver S around the calender roller(s) 20 and/or breakages of the sliver S causes a corresponding turning of the detector lever 101 on its apex pivot, and thereby the limit switch 105 is actuated so as to cancel the clutch engagement.

Next, the engagement and disengagement of the above-described electro-magnetic clutch 35, which are effected by the operations of the foregoing detecting devices, will be explained. When, in the arrangement shown in FIG. 4, the fiber tufts are caught around the feed roller 1, or the thickness of the supplied layer of the fiber tufts exceeds a prescribed limit, the feed roller 1 is lifted over a distance approximately corresponding to the thickness of the layer of fiber tufts wound around the feed roller 1 or to the increased thickness of the supplied abnormal layer of the fiber tufts. The corresponding lifting of the boss 82 of the feed roller 1 pushes up the detector nose 83 of the detector lever 81, and the lever 81 is thereby turned in the direction R in the illustration around the supporter shaft pivot 80, overcoming the pulling force by the tension spring 84. Due to this turning of the lever 81, the limit switch 85 is released from contact with the horizontal arm of the lever 81 and this causes a corresponding disengagement of the clutch 35. This disengagement of the clutch 35 cancels the drive transmission from the first drive motor 24 to the transmission shaft 37. Accordingly, rotations of the elements related to said shaft 37, such as the feed roller 1, are stopped and the supply of the fiber tufts via the feed roller is stopped.

Next, reference will be made again to the arrangement shown in FIG. 5. The abnormal winding of the web W around the clearer roller 86 lifts the roller 86 together with its supporter shaft, 87, along the supporting member 88 over a distance approximately equal to the thickness of the web layer on the roller 86. When the supporter shaft 87 has lifted over the prescribed extent, it comes in contact with the operating rod of the limit switch 89, the latter effects disengagement of the clutch 35 and, as in the previous case, the rotation of the feed roller 1 is stopped in order to interrupt the supply of the bale cotton L to the machine.

The clutch 35 is disengaged upon the occurrence of malfunctions in the second driving mechanism by the operation of the arrangement shown in FIG. 6. Should the belt 69, for driving the second cylinder 13, accidentally break, the tiltable lever 92 turns towards the limit switch 93, that is, counterclockwise in the drawing, due to its own weight and the spring force about its pivot, 90. The lever 92 so turned, comes in contact with the operating rod of the limit siwtch 93 and the latter operates to disengage the clutch 35.

On the other hand, when the belt 12 breaks for any reason while running, the tiltable lever 96 turns towards the limit switch 98, i.e. counterclockwise in the drawing, due to its own weight and the spring force about its pivot, 95. The contact of the lever 96 so turned, with the limit switch 98 causes a corresponding disengagement of the clutch 35. Therefore, the driving of the feed roller 1 is stopped so that the supply of the fiber tufts into the first carding mechanism is stopped, and the running of the other related rollers is also stopped.

The device shown in FIG. 7 functions when the sliver clogs within the coiler motion mechanism. The clogging of the sliver within the coiler tube 21 naturally results in the overflow of the sliver from the upstream terminal of the tube 21. The overflowing sliver pushes the operating rod of the limit switch 100, the latter causing disengagement of the electro-magnetic clutch 35 as in the preceding cases.

In the arrangement shown in FIGS. 8 and 9, when the sliver S winds around one of the calender rollers 20, the second roller of the pair of rollers, 20, moves away from the first roller through a distance approximately equal to the thickness of the sliver wound around the first roller. As a result of this displacement, the second roller 20 pushes the detector piece 101*a* of the detector lever 101, the latter turns counterclockwise in the drawing, the pressor piece 101*b* of the lever 101 is lifted, the operator lever 103 contacts the operator rod of the limit switch 105 received within its end cut-out, 102, and the limit switch 105 effects the corresponding disengagement of the clutch 35 so as to stop the supply of the fiber tufts by the feed roller 1, and to stop the running of the other related rollers.

When the sliver S breaks at any position upstream of the calender rollers 20, one of the rollers of the pair 20 moves towards the other roller of the roller pair 20 due to the absence of the sliver S, the detector piece 101*a* moves rightwardly in the drawing due to the spring force by the spring 104, the detector lever 101 turns clockwise in the drawing and the operator lever 103 is moved downwardly. Because the arrangement is so designed that the operating rod of the limit switch 105 is positioned at about the middle of the U-shaped cut-out 102 of the operator lever 103 under the neutral disposition, the above-described lowering of the operator lever 103 actuates the limit switch 105 and the latter functions so as to cause the disengagement of the clutch 35, and thereby the supply of the fiber tufts cotton to the machine via the feed roller 1 is stopped, and the running of the other related rollers are, also stopped.

As is understood from the foregoing description, according to one aspect of the present invention, the provision of local devices for detecting the occurrence of various malfunctions makes it possible to stop, via a corresponding disengagement of the electro-magnetic clutch 35, the rotations of the feed roller 1, the first doffer 6, the first stripping roller 7, the first transfer roller 8, the crashing rollers 9, the transferrer rollers 10 and 11, the second doffer 15, the second stripping roller 16, and the second transfer roller 17, the second crashing rollers 18, the draft roller 19 and the calender rollers 20 upon detection of occurrence of such malfunctions. The stoppage of the feed roller 1 naturally cuts off the supply of the fiber tufts to the machine, and thereby the development of these difficulties into even more serious difficulties can be effectively prevented.

Although the foregoing explanation is presented regarding the embodiment in which an electro-magnetic clutch 35 is used as a joint element of the drive transmission system, other types of clutches such as those utilizing pneumatic or hydraulic principles can be used in the present invention. It is preferable also that, together with the stop motion of the feed roller 1 upon the occurrence of the difficulties, suitable alarms should be automatically set off.

What is claimed is:

1. In an apparatus for driving a Tandem carding machine comprising a fiber tufts supply means including a feed roller, a first lickerin roller receptive of fiber tufts said supply means, a first carding mechanism receptive of fibers from said first lickerin roller, a first doffer receptive of carded fibers from said first carding mechanism, a first web transfer means receptive of fiber web from said first doffer, a second lickerin roller receptive of fibers from said first web transfer means, a second carding mechanism receptive of fibers from said second lickerin roller, a second doffer receptive of carded fibers from said second carding mechanism, a second web transfer means receptive of a continuous web from said second doffer, a pair of calender rollers and a coiler motion mechanism for encasing in a can a bundle of fibers in silver form from said second transfer means; said first carding mechanism comprising a first carding cylinder and a first flat for carding fiber tufts received from said first lickerin roller, said second carding mechanism comprising a second carding cylinder and a second flat for carding fibers received from said second lickerin roller; the improvement which comprises a first driving mechanism connected for driving said first lickerin roller and said first carding mechanism in synchronous condition a second driving mechanism connected fro driving said second lickerin roller and said second carding mechanism in synchronous condition, a fiber tufts supply mechanism for driving said fiber tuft supply means and said first doffer and said first web transfer means in synchronous condition, a second doffer driving mechanism for driving said second doffer, said calender rollers and said coiler motion mechanism and said second web transfer means in synchronous condition, a first driving motor for driving said first driving mechanism, a second driving motor for driving said second driving mechanism, means for transmitting driving power of said first driving mechanism to said fiber tufts supply mechanism and second doffer driving mechanism in synchronous condition, said means for transmitting driving power being provided with a clutch mechanism for connecting or disconnecting said means for transmitting driving power, and a variable speed device connected and arranged for changing input driving speeds of said second doffer driving mechanism and said fiber tufts supply mechanism in identical ratio between said driving speed of first driving mechanism and said second driving mechanism.

2. A driving apparatus for a Tandem carding machine as claimed in claim 1 wherein each said first driving mechanism and said second driving mechanism for said first and said second mechanism includes a drive belt having a prescribed magnitude of tension applied thereto, said driving mechanism of the second one of said two carding mechanisms is provided with a detector device engaging said belt of the second carding mechanism comprising a detector element tiltable in suitable direction upon accidental breakage of said belt and a limit switch operated by the tilting of said detector element; and wherein the detector device is operatively connected through said limit switch to disengage said clutch mechanism to substantially stop the running of said second driving mechanism by said second drive motor.

3. A driving apparatus for a Tandem carding machine as claimed in claim 1 including a detector device associated with said fiber tufts feed roller comprising a detector lever turnable on a fixed pivot and having a detector nose, a resilient element for urging said detector nose into a resilient surface pressure contact with the periphery of said feed roller, and a limit switch connected to said clutch mechanism and located near said detector lever in such an arrangement that the tuning of said detector lever over a prescribed extent upon the abnormal winding of said fiber tufts around said feed roller operates and limit switch to disengage said clutch mechanism.

4. A driving apparatus for a Tandem carding machine as claimed in claim 1, wherein wherein each said web transfer means includes a first stripping roller, a dection device associated with said first stripping roller comprising a clearer roller in engagement with said first stripping roller, a supporter shaft for said clearer roller movable vertically, a fixed guide for vertical movement of said supporter shaft, and a limit switch connected to said clutch mechanism and located relative to said supporter shaft in such an arrangement that the lifting of said supporter shaft over a prescribed extent upon the abnormal winding of said web around said first stripping roller operates said limit switch to disengage said clutch mechanism.

5. A driving apparatus for a Tandem carding machine as claimed in claim 1 including a detector device for said coiler motion mechanism comprising a limit switch connected to said clutch mechanism located near the upstream terminal of a coiler tube in such an arrangement that the overflowing of said sliver out of said coiler tube caused by accidental clogging of the same within said coiler tube operates said limit switch to disengage said clutch mechanism.

6. A driving apparatus for a Tandem carding machine as claimed in claim 1 including a detector device for said calender rollers comprising a detector lever turnable on a fixed pivot, a resilient element for urging said detector lever so that one end of said lever is put into a resilient pressure surface contact with the periphery of one of said calender rollers, and a limit switch connected to said clutch mechanism and located relative to the other end of said lever in such an arrangement that the turning of said lever over a prescribed extent upon the winding of said sliver around one of said calender rollers or sliver breakage operates said limit switch to disengage said clutch mechanism.

7. An improved apparatus for driving a Tandem carding machine according to claim 3, further comprising an electrical means for connecting said first driving motor and said second driving motor in such a way that said first driving motor will not be actuated to drive before actuation of said second driving motor at the time of starting the running of said Tandem carding machine while the running of said second driving motor will be stopped before said first driving motor at the time of stopping the running of said Tandem carding machine.

8. An improved apparatus for driving a Tandem carding machine according to claim 1, wherein said first driving mechanism comprises a first pulley and endless-belt power transmission mechanism for transmitting driving power of said first motor to said first carding mechanism and a second pulley and endless-belt power transmission mechanism for transmitting driving power of said first carding mechanism to said first lickerin roller.

9. An improved apparatus for driving a Tandem carding machine according to claim 1, wherein said second driving mechanism comprises a third pulley and endless-belt power transmission mechanism for transmitting driving power of said second motor to said second carding mechanism and a fourth pulley and endless-belt power transmission mechanism for transmitting driving power of said second carding mechanism to said second lickerin roller.

10. An improved apparatus for driving a Tandem carding machine according to claim 1, wherein a geared connection arranged for transmitting driving power to said first doffer, a further gearing mechanism connected to said geared connection and arranged for transmitting its driving power to said fiber tuft supply means, and means for transmitting driving power to said first web transfer means is provided.

* * * * *